US009243213B1

(12) United States Patent
Vetter et al.

(10) Patent No.: US 9,243,213 B1
(45) Date of Patent: Jan. 26, 2016

(54) FABRIC TREATMENT COMPOSITION COMPRISING AN AMINOSILOXANE POLYMER NANOEMULSION

(71) Applicant: The Procter & Gamble Company, Cincinnati, OH (US)

(72) Inventors: Nicholas David Vetter, Cleves, OH (US); Mark Robert Sivik, Mason, OH (US); Kristi Lynn Fliter, Harrison, OH (US); Patrick B Whiting, Cincinnati, OH (US); Harry W Broening, Milford, OH (US); Corey James Kenneally, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/341,994

(22) Filed: Jul. 28, 2014

(51) Int. Cl.

| | |
|---|---|
| ***C11D 1/82*** | (2006.01) |
| ***C11D 9/36*** | (2006.01) |
| ***C11D 9/44*** | (2006.01) |
| ***C11D 3/00*** | (2006.01) |
| ***C11D 3/16*** | (2006.01) |
| ***C11D 17/00*** | (2006.01) |

(52) U.S. Cl.
CPC ..... *C11D 3/0036* (2013.01); *C11D 3/162* (2013.01); *C11D 17/0017* (2013.01)

(58) Field of Classification Search
CPC ..... C11D 1/82; C11D 3/001; C11D 3/162; C11D 3/2068; C11D 3/373; C11D 7/263; C11D 9/225; C11D 9/36; C11D 9/44; C11D 17/0017; C11D 17/0021
See application file for complete search history.

(56) References Cited

U.S. PATENT DOCUMENTS

| | | | | |
|---|---|---|---|---|
| 6,180,117 | B1 * | 1/2001 | Berthiaume et al. | 424/401 |
| 8,633,146 | B2 | 1/2014 | Wang et al. | |
| 8,637,442 | B2 | 1/2014 | Wang et al. | |
| 2004/0029981 | A1 * | 2/2004 | Herzig et al. | 516/55 |
| 2008/0064813 | A1 * | 3/2008 | Schneider | 524/837 |
| 2012/0077725 | A1 | 3/2012 | Wang et al. | |
| 2013/0292600 | A1 | 11/2013 | Wang et al. | |
| 2013/0296218 | A1 | 11/2013 | Wang et al. | |
| 2015/0030644 | A1 * | 1/2015 | Oh et al. | 424/401 |
| 2015/0059793 | A1 * | 3/2015 | Berlepsch et al. | 132/204 |

OTHER PUBLICATIONS

U.S. Appl. No. 14/444,004, filed Jul. 28, 2014, Nicholas David Vetter, et al.

* cited by examiner

*Primary Examiner* — Charles Boyer
(74) *Attorney, Agent, or Firm* — Gregory S. Darley-Emerson; Leonard W Lewis; Steven W Miller

(57) ABSTRACT

The present invention relates to amino silicone nanoemulsions. More specifically, the present invention relates to amino silicone nanoemulsions that may be used to protect surfaces from being soiled or wetted.

12 Claims, No Drawings

FABRIC TREATMENT COMPOSITION COMPRISING AN AMINOSILOXANE POLYMER NANOEMULSION

FIELD OF THE INVENTION

The present invention relates to fabric treatment compositions comprising an aminosilioxane polymer nanoemulsion and methods of making said nanoemulsions and fabric treatment compositions. More specifically, the present invention relates to a process for making aminosiloxane polymer nanoemulsions that may be used to protect surfaces from being soiled or wetted.

BACKGROUND OF THE INVENTION

Numerous attempts have been made to develop a treatment composition that provides protection of surfaces by repelling water and oil based soils from the surface. Fluoropolymers, such as those used in Scotchguard® from 3M, have become well established as soil-repellant molecules. However, fluoropolymers are not preferred due to environmental, health and safety concerns, such as the potential and possibility of persistent bioaccumulation and toxicity.

Amino-modified silicone microemulsions that contain an amino-modified silicone and a high concentration of both ethylene glycol monoalkyl ether and nonionic surfactant, e.g., polyoxyalkylene branched decyl ether, are known and generally described as transparent in appearance and having a small particle diameter. However, these compositions have the challenge of delivering maximum hydrophobicity to a surface since they incorporate significant amounts of nonionic surfactant to obtain desired stability and particle sizes.

Unfortunately, to date, the attempts at non-fluorpolymer protection of surfaces continue to demonstrate disadvantages, including low efficiency, difficulty in achieving the desired benefits at affordable cost and in a preferred format, processing and formulation challenges, and product instability. A continued need exists for a non-fluoropolymer technology that delivers depositable benefits to surfaces, such as water and oily soil repellency, in a convenient and stable form and at a high efficiency.

Even attempts at using non-fluoropolymer technologies have been less than successful due to a general failure to recognize the importance of the order of addition of materials during the making process as well as the processing conditions themselves, in addition to optimization of the solvent system, addition of adjunct ingredients that can enhance performance, and equally the removal of adjuncts that can hinder performance. Applicants have found that by optimizing the order of addition of the raw materials during emulsion making and finished product formulation using said emulsion, the overall stability of the emulsion and finished product can be greatly enhanced. Furthermore, the deposition efficiency and overall soil repellency benefit can be maximized, whilst minimizing the potential for negative results often seen with silicone-containing compositions, such as staining or spotting of fabrics, laundry machine residues, and product discoloration.

SUMMARY OF THE INVENTION

The present invention provides a fabric treatment composition comprising a nanoemulsion made by a process comprising the steps of:

a) solubilizing a silicone resin in an organic solvent system to yield a silicone resin solution concentration of about 80% or less, wherein the organic solvent system comprises diethyleneglycol monobutyl ether and at least one additional solvent selected from the list consisting of monoalcohols, polyalcohols, ethers of monoalcohols, ethers of polyalcohols, fatty esters, Guerbet alcohols, isoparaffins, naphthols, glycol ethers or mixtures thereof, provided that if the additional solvent is a glycol ether it is not diethyleneglycol monobutyl ether;
b) mixing the silicone resin solution from a) with an aminosiloxane polymer to obtain an aminosiloxane polymer:silicone resin mixture having ratio of about 20:1;
c) allowing the aminosiloxane polymer:silicone resin mixture to age for at least about 6 hours at ambient temperature;
d) adding the aminosiloxane polymer:silicone resin mixture to a vessel;
e) optionally adding with agitation an additional organic solvent to the aminosiloxane polymer:silicone resin mixture;
f) mixing until homogenous;
g) adding a protonating agent;
h) additionally adding an aqueous carrier in an amount to produce the desired concentration of emulsion.

The present invention attempts to solve one more of the needs by providing, in one aspect of the invention, a method of making an aminosiloxane polymer nanoemulsion which can be incorporated into a surface treatment composition, comprising the nanoemulsion. Said nanoemulsion comprising a silicone resin, an aminosiloxane polymer having an amine equivalent of less than about 0.6 meq/g, wherein said polymer has greater than about 5% but less than about 25% of terminal groups comprising hydroxyl functionality; at least one an organic solvent selected from the group consisting of linear alcohols, branched alcohols, Guerbet alcohols, fatty esters, glycol ethers, isoparaffins, naphthols, and mixtures thereof; optionally a second organic solvent; an aqueous carrier; a protonating agent; optionally, a deposition aid polymer selected from cationic and amphoteric polymers, and adjunct ingredients; wherein said nanoemulsion is substantially free of surfactant.

Another aspect of the invention includes treatment compositions comprising the amino silicone nanoemulsions as described herein. Other aspects of the invention include methods of making treatment compositions comprising the amino silicone nanoemulsions and methods of treating surfaces with treatment compositions comprising the amino silicone nanoemulsions.

DETAILED DESCRIPTION OF THE INVENTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein, the terms "substantially free of" or "substantially free from" means that the indicated material is at the very minimum not deliberately added to the composition to form part of it, or, preferably, is not present at analytically detectable levels. It is meant to include compositions whereby the indicated material is present only as an impurity in one of the other materials deliberately included.

Preferably, substantially free from surfactant means that the emulsion comprises at most 1 percent by weight of surfactant, more preferably at most 0.1 percent by weight of surfactant.

As used herein, the term nanoemulsion refers to thermodynamically stable oil in water emulsions that have extremely small droplet sizes (below 750 nm, or typically below 250 nm).

These materials have special properties, including optical translucency, very large dispersed phase surface-to-volume ratios and long term kinetic stability. Due to similarity in appearance, translucent nanoemulsions are sometimes confused with microemulsions, which belong to another class of stable (thermodynamically) and optically clear colloidal systems. Microemulsions are spontaneously formed by "solubilizing" oil molecules with a mixture of surfactants, co-surfactants and co-solvents. The required surfactant concentration in a microemulsion is typically several times higher than that in a nanoemulsion and significantly exceeds the concentration of the dispersed phase (generally, oil). Because of many undesirable side-effects caused by surfactants, this is disadvantageous or prohibitive for many applications. In addition, the stability of microemulsions is easily compromised by dilution, heating, or changing pH levels. By contrast nanoemulsions in accordance with the present invention are formed by judiciously selecting solvent systems that provide adequate dissolution of the siloxanes and also exhibit some level of miscibility with water, thus a stable aqueous emulsion can be achieved without the use of surfactants. Without wishing to be bound by theory, applicants believe that choosing a solvent or solvent system whereby the solvents exhibit dual polarity, these solvents of choice can behave similarly to surfactants in solution without introducing the wetting effect that surfactants typically bring. Thus, it is possible to deliver an oil-in-water emulsion, without having surfactant present, that is capable of providing maximum hydrophobicity to a target surface.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the total nanoemulsion composition, all pressures are equal to 0.10 MPa (absolute) and all temperatures are equal to 20° C. unless otherwise specified.

Known amino silicone microemulsions and methods for preparing amino silicone microemulsions employ high levels of solvent and nonionic surfactant (e.g., 12% ethylene glycol monohexyl ether per 100% of amino silicone and 40% polyoxyalkylene branched decyl ether per 100% of amino silicone), and/or require high energy in the form of heat or high shearing forces in order to obtain the desired nanoparticle size. Without being bound by theory, it is believed that the presence of high levels of solvent and surfactant in the emulsion hinders the deposition of the amino silicone on the surface that is to be treated; amino silicone droplets in high-solvent and high-surfactant emulsions tend to stay in the emulsion, rather than deposit on the surface. This results in a poor delivery of any benefit, such as increased water repellency or oil repellency, to the surface. Such benefits may be measured as an increased time to wick on treated fabrics, a reduced dry-time for treated fabrics and/or an increased contact angle on a hard surface.

In contrast to conventional amino silicone microemulsions, the amino silicone nanoemulsions of the present invention comprise reduced levels of solvent and no intentionally added surfactant and may be obtained without the input of high energy to process the emulsion. Yet, the amino silicone nanoemulsions disclosed herein provide highly efficient deposition on a target surface. Benefits derived from this deposition may generally apply in the area of repellency of water and/or water-based compositions and/or oil and/or oil-based compositions, such as water-based stains and oily soils. Without being bound by theory, it is believed that the amino silicone nanoemulsions disclosed herein comprise self-assembled, spherical, positively charged amino silicone nanoparticles (which contain reduced levels of solvent and surfactant). These self-assembled, spherical, positively charged nano-particles exhibit efficient deposition and controlled spreading, that is believed to form a structured film on a surface that provides the repellency benefit as determined by the below specified time to wick method.

The average particle sizes of the disclosed nanoemulsions range from about 20 nm to about 750 nm, or about 20 nm to about 500 nm, or about 50 nm to about 350 nm, or about 80 nm to about 200 nm, or about 90 nm to about 150 nm. (as measured by Malvern Zetasizer Nano Series instrument). The disclosed nanoemulsions are generally transparent or slightly milky in appearance.

Silicone Resin

Typically, the amino silicone nanoemulsion of the present invention comprises a silicone resin.

An example of a silicone resin is a mixture of polyorganosiloxane-silicone resins, where each of the one or more silicone resins of the polyorganosiloxane-silicone resin mixture contains at least about 80 mol % of units selected from the group consisting of units of the general formulas 3, 4, 5, 6:

$$R_3SiO_{1/2} \quad (3),$$

$$R_2SiO_{2/2} \quad (4),$$

$$RSiO_{3/2} \quad (5),$$

$$SiO_{3/2} \quad (5),$$

in which R is selected from H, —$OR^{10}$, or —OH residues or monovalent hydrocarbon residues with 1 to 40 carbon atoms, optionally substituted with halogens, where at least 20 mol % of the units are selected from the group consisting of units of the general formulas (5) and (6), and a maximum of 10 wt % of the R residues are —$OR^{10}$ and —OH residues.

The silicone resins may preferably be MQ silicon resins (MQ) comprising at least 80 mol % of units, preferably at least 95 mol % and particularly at least 97 mol % of units of the general formula (3) and (6). The average ratio of units of the general formula (3) to (6) is preferably at least 0.25, particularly at least 0.5, preferably at most 4, and more preferably at most 1.5.

The silicon resins may also preferably be DT silicone resins (DT) comprising at least 80 mol % of units, preferably at least 95 mol % and particularly at least 97 mol % of units of the general formula (4) and (5). The average ratio of units of the general formula (4) to (5) is preferably at least 0.01, particularly at least 0.2, preferably at most 3.5, and more preferably at most 0.5.

Preferred halogen substituents of the hydrocarbon residues R are fluorine and chlorine. Preferred monovalent hydrocarbyl radicals R are methyl, ethyl, phenyl.

Preferred monovalent hydrocarbyl radicals $R^{10}$ are methyl, ethyl, propyl and butyl.

Aminosiloxane Polymer Suitable aminosiloxane polymers are represented by of one or more liquid aminoalkyl-containing polyorganosiloxanes (P) comprising at least 80 mol % of units selected from units of the general formulas (7), (8), (9) and (10):

$$R^1{}_2SiO_{2/2} \quad (7),$$

$$R^1{}_aR^2{}_bSiO_{(4-a-b)/2} \quad (8),$$

$$R^3{}_3SiO_{(1/2)} \quad (9),$$

$$R^3{}_2R^4SiO_{(1/2)} \quad (10),$$

where a has the value 0 or 1, b has the value 1 or 2, a+b has a value of 2, $R^1$ represents monovalent hydrocarbyl radicals having 1-40 carbon atoms and optionally substituted with halogens, $R^2$ represents either a) aminoalkyl radicals of the general formula (11)

$$—R^5—NR^6R^7 \quad (11)$$

where $R^5$ represents divalent hydrocarbyl radicals having 1-40 carbon atoms, $R^6$ represents monovalent hydrocarbyl radicals having 1-40 carbon atoms, H, hydroxymethyl or alkanoyl radicals, and $R^7$ represents a radical of the general formula (12)

$$—(R^8—NR^6)_xR^6 \quad (12)$$

where x has the value 0 or an integer value from 1 to 40, and $R^8$ represents a divalent radical of the general formula (13)

$$—(CR^9{}_2—)_y \quad (13)$$

where y has an integer value from 1 to 6, and $R^9$ represents H or hydrocarbyl radicals having 1-40 carbon atoms, or b) in the general formula (11) $R^6$ and $R^7$ combine with the nitrogen atom to form a cyclic organic radical having 3 to 8 $—CH_2—$ units, although nonadjacent $—CH_2—$ units may be replaced by units selected from —C(═O)—, —NH—, —O— and —S—, $R^3$ represents hydrocarbyl radicals having 1-40 carbon atoms and optionally substituted with halogens, $R^4$ represents —OR or —OH radicals, and wherein, in the polyorganosiloxanes (P), the average ratio of the sum of units of the general formula (7) and (8) to the sum of units of the general formula (9) and (10) is in the range from 0.5 to 500, the average ratio of units (9) to (10) being in the range from 1.86 to 100, and the polyorganosiloxanes (P) have an average amine number of at least 0.01 mequiv/g.

The monohydric hydrocarbyl radicals R, $R^1$, $R^3$, $R^6$, $R^9$ and $R^{10}$ may be halogen substituted, linear, cyclic, branched, aromatic, saturated or unsaturated. Preferably, the monovalent hydrocarbyl radicals R, $R^1$, $R^3$, $R^6$, $R^9$ and $R^{10}$ each have 1 to 6 carbon atoms, and particular preference is given to alkyl radicals and phenyl radicals. Preferred halogen substituents are fluorine and chlorine. Particularly preferred monovalent hydrocarbyl radicals R, $R^1$, $R^3$, $R^6$, $R^9$ and $R^{10}$ are methyl, ethyl, phenyl.

The divalent hydrocarbyl radicals $R^5$ may be halogen substituted, linear, cyclic, branched, aromatic, saturated or unsaturated. Preferably, the $R^5$ radicals have 1 to 10 carbon atoms, and particular preference is given to alkylene radicals having 1 to 6 carbon atoms, in particular propylene. Preferred halogen substituents are fluorine and chlorine.

Preferred $R^6$ radicals are alkyl and alkanoyl radicals. Preferred halogen substituents are fluorine and chlorine. Preferred alkanoyl radicals are —C(═O)$R^{11}$, where $R^{11}$ has the meanings and preferred meanings of $R^1$. Particularly preferred substituents $R^6$ are methyl, ethyl, cyclohexyl, acetyl and H. It is particularly preferable for the $R^6$ and $R^7$ radicals to have the meaning H.

Preferred cyclic organic radicals formed from $R^6$ and $R^7$ in the general formula (11) together with the attached nitrogen atom are the five and six rings, in particular the residues of pyrrolidine, pyrrolidin-2-one, pyrrolidine-2,4-dione, pyrrolidin-3-one, pyrazol-3-one, oxazolidine, oxazolidin-2-one, thiazolidine, thiazolidin-2-one, piperidine, piperazine, piperazine-2,5-dione and morpholine.

Particularly preferred $R^2$ radicals are $—CH_2NR^6R^7$, $—(CH_2)_3NR^6R^7$ and $—(CH_2)_3N(R^6)(CH_2)_2N(R^6)_2$. Examples of particularly preferred $R^2$ radicals are aminoethylamino-propyl and cyclohexylaminopropyl.

Preference is also given to mixtures (M) wherein at least 1 mol %, more preferably at least 5 mol %, particularly at least 20 mol % and at most 90 mol %, more preferably at most 70 mol % and particularly at most 60 mol % of the $R^6$ and $R^7$ radicals are acetyl radicals and the remaining $R^6$ and $R^7$ radicals have the meaning H.

Preferably, b is 1. Preferably, a+b has an average value from 1.9 to 2.2.

Preferably, x has the value 0 or a value from 1 to 18, more preferably 1 to 6.

Preferably, y has the values of 1, 2 or 3.

Preferably, the polydiorganosiloxanes (P) comprise at least 3 and particularly at least 10 units of the general formula (7) and (8).

Preferably, the liquid aminoalkyl-containing polyorganosiloxanes (P) comprise at least 95 mol %, more preferably at least 98 mol % and particularly at least 99.5 mol % of units selected from units of the general formula (7), (8), (9) and (10).

Further units of the polyorganosiloxanes (P) can be selected for example from units selected from units of the general formulae (3), (4,) (5) and (6).

The ratio of a to b is chosen such that the polyorganosiloxanes (P) preferably have an amine number of at least 0.1, in particular at least 0.3 mequiv/g of polyorganosiloxane (P). The amine number of the polyorganosiloxanes (P) is preferably at most 7, more preferably at most 4.0 and particularly at most 3.0 mequiv/g of polyorganosiloxane (P).

The amine number designates the number of ml of 1N HCl which are required for neutralizing 1 g of polyorganosiloxane (P).

The viscosity of the polyorganosiloxanes (P) is preferably at least 1 and particularly at least 10 mPa·s and preferably at most 100,000 and particularly at most 10,000 mPa·s at 25° C.

The ratio of the units of the general formula (7) and (8) to the sum total of (9) and (10) is preferably at least 10, particularly at least 50 and preferably at most 250, particularly at most 150.

The ratio of units (9) to (10) is preferably at least 1.9 and particularly at least 2.0 and preferably at most 70 and particularly at most 50.

The polyorganosiloxanes (P) are obtainable via known chemical processes such as, for example, hydrolysis or equilibration.

Organic Solvent System

The amino silicone nanoemulsion of the present invention comprises from about 0.1% to about 50% of one or more solvents, by weight of the amino silicone. In certain aspects, the amino silicone nanoemulsion comprises from about 5% to about 30% of one or more solvents, by weight of the amino silicone. In some aspects, the amino silicone nanoemulsion comprises from about 10% to about 25% of one or more solvents, by weight of the amino silicone. In other aspects, the amino silicone nanoemulsion comprises from about 15% to about 23% or from about 18% to about 21% of one or more solvents, by weight of the amino silicone.

In one aspect of the invention the solvent system contains at least two solvents wherein one is diethyleneglycol monobutyl ether, such as that sold under the trade name Butyl Carbitol™ from Dow Chemical (Midland, Mich.), and additional solvent(s) are selected from monoalcohols, polyalcohols, ethers of monoalcohols, ethers of polyalcohols, fatty esters, Guerbet alcohols, isoparaffins, naphthols, glycol ethers or mixtures thereof, provided that if the additional solvent is a glycol ether it is not diethyleneglycol monobutyl ether.

In some aspects, the solvent is selected from a mono-, di-, or tri-ethylene glycol monoalkyl ether that comprises an alkyl group having 1-12 carbon atoms, or a mixture thereof. Suitable alkyl groups include methyl, ethyl, propyl, butyl groups, hexyl groups, heptyl groups, octyl groups, nonyl groups, decyl groups, undecyl groups, phenyl, and dodecyl groups, as well as acetate groups of each.

Suitable examples of monoethylene glycol monoalkyl ethers, include ethyleneglycol methyl ether, ethyleneglycol ethyl ether, ethyleneglycol propyl ether, ethyleneglycol butyl ether, ethyleneglycol butyl ether acetate, ethyleneglycol phenyl ether, ethyleneglycol hexyl ether, and combinations thereof. Suitable examples of diethylene glycol monoalkyl ethers, include diethyleneglycol methyl ether, diethyleneglycol ethyl ether, diethyleneglycol propyl ether, diethyleneglycol butyl ether, diethyleneglycol phenyl ether, diethyleneglycol hexyl ether, and combinations thereof.

In some aspects, the solvent is selected from a mono-, di-, or tri-propylene glycol monoalkyl ether that comprises an alkyl group having 1-12 carbon atoms, or a mixture thereof. Suitable alkyl groups include methyl, ethyl, propyl, butyl groups, hexyl groups, heptyl groups, octyl groups, nonyl groups, decyl groups, undecyl groups, phenyl, and dodecyl groups, as well as acetate groups of each.

Suitable examples of monopropylene glycol monoalkyl ethers, include propyleneglycol methyl ether, propyleneglycol methyl ether acetate, propyleneglycol methyl ether diacetate, propyleneglycol propyl ether, propyleneglycol butyl ether, propyleneglycol phenyl ether, and combinations thereof. Suitable examples of dipropylene glycol monoalkyl ethers, include dipropyleneglycol methyl ether, dipropyleneglycol methyl ether acetate, dipropyleneglycol propyl ether, dipropyleneglycol butyl ether, and combinations thereof. Suitable examples of tripropylene glycol monoalkyl ethers, include tripropyleneglycol methyl ether, tripropyleneglycol propyl ether, tripropyleneglycol butyl ether, and combinations thereof.

In some aspects the solvent is selected from fatty esters such as isopropyl esters of long chain fatty acids having 8 to 21 carbon atoms. Suitable examples of fatty esters include isopropyl laurate, isopropyl myristate, isopropyl palmitate, isopropyl stearate, isopropyl oleate, isopropyl linoleate, and combinations thereof.

In some aspects, the solvent comprises a linear or branched mono- or polyhydric alcohol, or a Guerbet alcohol, such as 2-ethylhexanol, 2-butyloctanol, or 2-hexyldecanol, or mixtures thereof.

In some aspects the solvent comprises a naphthol or isoparaffin having from about 8 to about 16 carbon atoms, such as isoparaffins sold under the trade name Isopar E™, Isopar L™, Isopar G™, or Isopar M™ (available from ExxonMobile Chemicals, Houston, Tex.).

Protonating Agent

The protonating agent is generally a monoprotic or multiprotic, water-soluble or water-insoluble, organic or inorganic acid. Suitable protonating agents include, for example, formic acid, acetic acid, propionic acid, malonic acid, citric acid, hydrochloric acid, sulfuric acid, phosphoric acid, nitric acid, or mixtures thereof. In some aspects, the protonating agent is selected from formic acid, acetic acid, or a mixture thereof. In some aspects, the protonating agent is acetic acid. Generally, the acid is added in the form of an acidic aqueous solution. The protonating agent is added in an amount necessary to achieve a nanoemulsion pH of from about 3.5 to about 7.0. In certain aspects, the aminosiloxane polymer nanoemulsions comprise the protonating agent in an amount necessary to achieve a pH of from about 3.5 to about 6.5 or about 4.0 to about 6.0. In other aspects, the aminosiloxane polymer nanoemulsions comprise the protonating agent in an amount necessary to achieve a pH of most preferably from about 3.5 to about 5.0.

Water

The aminosilicone nanoemulsions of the present invention can be diluted to produce any desired concentration of nanoemulsion by the addition of water.

Optional Adjunct Ingredients

The amino silicone nanoemulsions may additionally include further substances, such as preservatives, scents, corrosion inhibitors, UV absorbers, structurants, opacifiers, optical brighteners, and dyes. Examples of preservatives are alcohols, formaldehyde, parabens, benzyl alcohol, propionic acid and salts thereof and also isothiazolinones. The nanoemulsions may further include yet other additives, such as non-silicon-containing oils and waxes. Examples thereof are rapeseed oil, olive oil, mineral oil, paraffin oil or non-silicon-containing waxes, for example carnauba wax and candelilla wax incipiently oxidized synthetic paraffins, polyethylene waxes, polyvinyl ether waxes and metal-soap-containing waxes. In some aspects, the amino silicone nanoemulsions further comprise carnauba wax, paraffin wax, polyethylene wax, or a mixture thereof. The nanoemulsions may comprise up to about 5% by weight of the nanoemulsion or from about 0.05% to about 2.5% by weight of the nanoemulsion of such further substances.

Method of Making

The method for preparing the amino silicone nanoemulsions of the present invention includes the steps of: solubilizing the silicone resin in an organic solvent or mixture of organic solvents to yield a resin solution concentration of about 80% or less, preferably of about 70% or less, more preferably of about 60% or less, or most preferably of about 55% or less, followed by mixing the resin solution with an amino siloxane polymer to obtain an amino siloxane polymer:resin ratio of about 20:1, preferably about 10:1, more preferably about 7:1, most preferably about 5.8:1, and allowing the mixture to age for at least about 6 hours at room temperature; the emulsion is then prepared by adding the amino siloxane polymer:resin mixture to a vessel containing a small amount of water with agitation, optionally followed by addition of a second organic solvent to aid in the dispersion of the amino siloxane polymer:resin mixture in aqueous carrier; once the solvent, silicone and carrier mixture has become homogenous, then the protonating agent is added, followed by additional amounts of carrier to produce a nanoemulsion at the desired concentration. Optional adjunct materials are then added to the mixture and agitated until thoroughly mixed.

Treatment Composition

The amino silicone nanoemulsions of the present invention may be incorporated into treatment compositions or cleaning compositions, such as, but not limited to, a fabric care composition, a hard surface care composition, or a home care composition. In some aspects, the treatment composition comprises from about 0.001% to about 99% by weight of the composition, of the amino silicone nanoemulsion. In certain aspects, the treatment composition comprises from about 0.001% to about 40%, or from about 0.1% to about 35%, or from about 1% to about 30%, or from about 5% to about 25%, or from about 9% to about 22% or from about 13% to about 18% of the amino silicone nanoemulsion, by weight of the composition.

In one aspect, the fabric treatment composition comprising a nanoemulsion of the present invention may be made according to a process comprising the steps of:

a) solubilizing a silicone resin in an organic solvent system to yield a silicone resin solution concentration of about 80% or less, wherein the organic solvent system comprises a single solvent selected from the group consisting of monoalcohols, polyalcohols, ethers of monoalcohols, ethers of polyalcohols, fatty esters, Guerbet alcohols, isoparaffins, naphthols, glycol ethers, provided that if the solvent is a glycol ether it is not diethyleneglycol monobutyl ether; b) mixing the silicone resin solution from a) with an aminosiloxane polymer to obtain an aminosiloxane polymer:silicone resin mixture having ratio of about 20:1;
c) allowing the aminosiloxane polymer:silicone resin mixture to age for at least about 6 hours at ambient temperature;
d) adding the aminosiloxane polymer:silicone resin mixture to a vessel;
e) optionally adding with agitation an additional organic solvent to the aminosiloxane polymer:silicone resin mixture;
f) mixing until homogenous;
g) adding a protonating agent;
h) additionally adding an aqueous carrier in an amount to produce the desired concentration of nanoemulsion
i) adding the nanoemulsion to a vessel;
j) optionally, adding to the vessel containing the aforementioned nanoemulsion a perfume oil;
k) adding an organic solvent;
l) optionally, adding a deposition aid polymer;
m) adding additional water to achieve the desired finished product concentration;
n) optionally, adding a preservative;
o) optionally, adding a dispersant;
p) adding a protonating agent; and
q) optionally, adding a dye.

Examples of treatment compositions include, but are not limited to, laundry spray treatment products, laundry pre-treatment products, fabric enhancer products, hard surface treatment compositions (hard surfaces include exterior surfaces, such as vinyl siding, windows, and decks), carpet treatment compositions, and household treatment compositions. Examples of fabric care compositions suitable for the present disclosure include, but are not limited to, laundry spray treatment products, laundry pre-treatment products, laundry soak products, and rinse additives. Examples of suitable home care compositions include, but are not limited to, rug or carpet treatment compositions, hard surface treatment compositions, floor treatment compositions, and window treatment compositions.

In some aspects, the treatment composition may be provided in combination with a nonwoven substrate, as a treatment implement.

In certain aspects, the compositions provide water and/or oil repellency to the treated surfaces, thereby reducing the propensity of the treated surface to become stained by deposited water- or oil-based soils.

By "surfaces" it is meant any surface. These surfaces may include porous or non-porous, absorptive or non-absorptive substrates. Surfaces may include, but are not limited to, celluloses, paper, natural and/or synthetic textiles fibers and fabrics, imitation leather and leather. Selected aspects of the present invention are applied to natural and/or synthetic textile fibers and fabrics.

By "treating a surface" it is meant the application of the composition onto the surface. The application may be performed directly, such as spraying or wiping the composition onto a hard surface. The composition may or may not be rinsed off, depending on the desired benefit.

The present invention also encompasses the treatment of a fabric as the surface. This can be done either in a "pretreatment mode", where the composition is applied neat onto the fabric before the fabrics are washed or rinsed, or a "post-treatment mode", where the composition is applied neat onto the fabric after the fabric is washed or rinsed. The treatment may be performed in a "soaking mode", where the fabric is immersed and soaked in a bath of neat or diluted composition. The treatment may also be performed in a "through the wash" or "through the rinse" mode where the treatment composition, as defined herein, is added to the wash cycle or the rinse cycle of a typical laundry wash machine cycle. When used in the wash or rinse cycle, the compositions are typically used in a diluted form. By "diluted form" it is meant that the compositions may be diluted in the use, preferably with water at a ratio of water to composition up to 2000:1, or from 1:1 to about 1000:1, or from 3:1 to about 500:1, or from 5:1 to 200:1, or from 10:1 to 80:1.

Such treatment compositions may comprise carriers, which may be any known material that is useful in delivering the treatment compositions to the surface to be treated. The carrier may be as simple as a single component delivery vehicle, such as water or alcohol, which would allow the nanoemulsion to be sprayed onto a surface. Alternatively, the carrier may be complex, such as a cleaning composition, e.g., a laundry detergent where the nanoemulsion would be applied in conjunction with the other beneficial uses of the complex carrier.

Such treatment compositions may comprise various other materials, including bleaching agents, bleach activators, builders, chelating agents, smectite clays, dye transfer inhibiting agents, dispersants, enzymes, and enzyme stabilizers, catalytic metal complexes, polymeric dispersing agents, clay and soil removal/anti-redeposition agents, brighteners, suds suppressors, suds boosters, dyes, additional perfumes and perfume delivery systems, structure elasticizing agents, fabric softeners, carriers, hydrotropes, processing aids and/or pigments.

Deposition Assisting Polymer or Deposition Polymer—The compositions of the present invention contain non-polysaccharide based cationic copolymers comprising the polymerized monomer unit residues of one or more ethylenically unsaturated cationic or amine monomers and one or more ethylenically unsaturated nonionic monomer and optionally one or more ethylenically unsaturated anionic monomers. When anionic monomeric units are present in the polymer, it is understood that the polymer is net cationic i.e., the number of cationic monomeric units are more than the number of anionic monomeric units in the polymer chain. Specifically, the cationic polymers are compatible with detersive enzymes in the detergent composition and are capable of assisting and/or enhancing the deposition of benefit agents onto fabrics during laundering.

Exemplary cationic or amine monomers useful in this invention are N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium chloride, acrylamidoalkylltrialkylamminium chloride, vinylamine, vinyl imidazole, quaternized vinyl imidazole and diallyl dialkyl ammonium chloride. Preferred cationic and amine monomers are N,N-dimethyl aminoethyl acrylate, N,N-dimethyl aminoethyl methacrylate (DMAM), [2-(methacryloylamino)ethyl]tri-methylammonium chloride (QDMAM), N,N-dimethylaminopropyl acrylamide (DMAPA), N,N-dimethylaminopropyl methacrylamide (DMAPMA), acrylamidopropyl trimethyl ammonium chloride, methacrylamidopropyl trimethylammonium chloride (MAPTAC), quatemized vinyl imidazole and diallyldimethylammonium chloride.

Exemplary nonionic monomers suitable for use in this invention are acrylamide (AM), N,N-dialkyl acrylamide, methacrylamide, N,N-dialkylmethacrylamide, C1-C12 alkyl acrylate, C1-C12 hydroxyalkyl acrylate, C1-C12 hydroxyetheralkyl acrylate, C1-C12 alkyl methacrylate, C1-C12 hydroxyalkyl methacrylate, vinyl acetate, vinyl alcohol, vinyl formamide. Preferred nonionic monomers are acrylamide, N,N-dimethyl acrylamide, C1-C4 alkyl acrylate, C1-C4 hydroxyalkylacrylate, vinyl formamide, vinyl acetate, and vinyl alcohol. Most preferred nonionic monomers are acrylamide, hydroxyethyl acrylate (HEA), hydroxypropyl acrylate (HPA), vinyl formamide, vinyl acetate, and vinyl alcohol.

Cationic Monomers

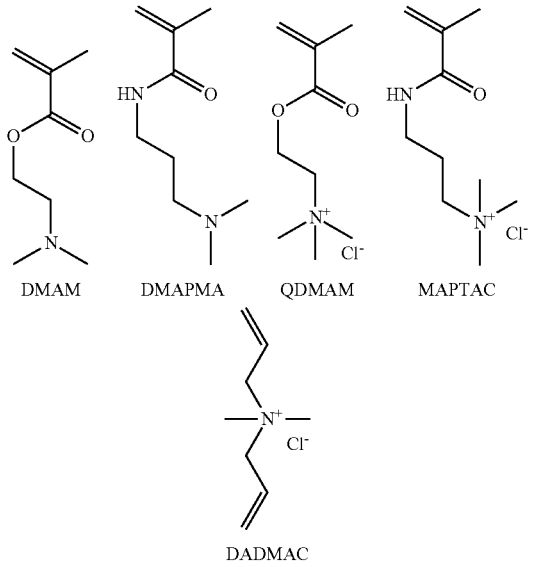

-continued

Neutral Monomers

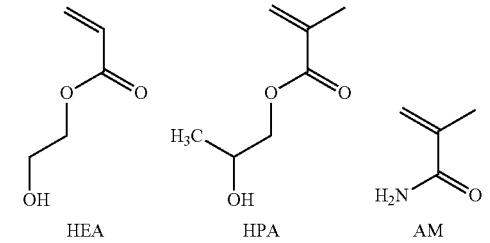

The polymer may optionally comprises anionic monomers, such as acrylic acid, methacrylic acid, maleic acid, vinyl sulfonic acid, styrene sulfonic acid, acrylamidopropylmethane sulfonic acid (AMPS) and their salts.

The polymer may optionally be cross-linked. Crosslinking monomers include, but are not limited to, ethylene glycoldiacrylatate, divinylbenzene, butadiene.

The most preferred polymers are poly(acrylamide-co-diallyldimethylammonium chloride), poly(acrylamide-methacrylamidopropyltrimethyl ammonium chloride), poly(acrylamide-co-N,N-dimethyl aminoethyl methacrylate), poly (acrylamide-co-N,N-dimethyl aminoethyl methacrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride).

In order for the deposition polymers to be formulable and stable in the composition, it is important that the monomers are incorporated in the polymer to form a copolymer, especially true when monomers have widely different reactivity ratios are used. In contrast to the commercial copolymers, the deposition polymers herein have a free monomer content less than 10%, preferably less than 5%, by weight of the monomers. Preferred synthesis conditions to produce reaction products containing the deposition polymers and low free monomer content are described below.

The deposition assisting polymers can be random, block or grafted. They can be linear or branched. The deposition assisting polymers comprises from about 1 to about 60 mol percent, preferably from about 1 to about 40 mol percent, of the cationic monomer repeat units and from about 98 to about 40 mol percent, from about 60 to about 95 mol percent, of the nonionic (i.e., "neutral") monomer repeat units.

The deposition assisting polymer has a charge density of about 0.1 to about 5.0 milliequivalents/g (meq/g) of dry polymer, preferably about 0.2 to about 3 meq/g. This refers to the charge density of the polymer itself and is often different from the monomer feedstock. For example, for the copolymer of acrylamide and diallyldimethylammonium chloride with a monomer feed ratio of 70:30, the charge density of the feed monomers is about 3.05 meq/g. However, if only 50% of diallyldimethylammonium is polymerized, the polymer charge density is only about 1.6 meq/g. The polymer charge density is measured by dialyzing the polymer with a dialysisis membrane or by NMR. For polymers with amine monomers, the charge density depends on the pH of the carrier. For these polymers, charge density is measured at a pH of 7. The weight-average molecular weight of the polymer will generally be between 10,000 and 5,000,000, preferably from 100,000 to 2,00,000 and even more preferably from 200,000 and 1,500,000, as determined by size exclusion chromatography relative to polyethyleneoxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 mL/min.

Perfume—The treatment composition of the present disclosure may optionally comprise a perfume component selected from the group consisting of:

(1) a perfume microcapsule, or a moisture-activated perfume microcapsule, comprising a perfume carrier and an encapsulated perfume composition, wherein said perfume carrier may be selected from the group consisting of cyclodextrins, starch microcapsules, porous carrier microcapsules, and mixtures thereof; and wherein said encapsulated perfume composition may comprise low volatile perfume ingredients, high volatile perfume ingredients, and mixtures thereof;

(2) a pro-perfume;

(3) a low odor detection threshold perfume ingredients, wherein said low odor detection threshold perfume ingredients may comprise less than about 25%, by weight of the total neat perfume composition; and (4) mixtures thereof.

Microcapsule—The treatment composition of the present disclosure may comprise from about 0.05% to about 5%; or from about 0.1% to about 1% of a microcapsule. In one aspect, the microcapsule may comprise a shell comprising a polymer crosslinked with an aldehyde. In one aspect, the microcapsule may comprise a shell comprising a polymer selected from the group consisting of polyurea, polyurethane, polyamine, urea crosslinked with an aldehyde or melamine crosslinked with an aldehyde. Examples of materials suitable for making the shell of the microcapsule include melamine-formaldehyde, urea-formaldehyde, phenol-formaldehyde, or other condensation polymers with formaldehyde.

In one aspect, the microcapsules may vary in size (i.e., the maximum diameter is from about 1 to about 75 microns, or from about 5 to about 30 microns). The capsules may have an average shell thickness ranging from about 0.05 to about 10 microns, alternatively from about 0.05 to about 1 micron.

In one aspect, the microcapsule may comprise a perfume microcapsule. In turn, the perfume core may comprise a perfume and optionally a diluent. Suitable perfume microcapsules may include those described in the following references: published USPA Nos 2003-215417 A1; 2003-216488 A1; 2003-158344 A1; 2003-165692 A1; 2004-071742 A1; 2004-071746 A1; 2004-072719 A1; 2004-072720 A1; 2003-203829 A1; 2003-195133 A1; 2004-087477 A1; 2004-0106536 A1; U.S. Pat. Nos. 6,645,479; 6,200,949; 4,882,220; 4,917,920; 4,514,461; RE32713; U.S. Pat. No. 4,234,627; EP 1393706 A1. Capsules having a perfume loading of from about 50% to about 95% by weight of the capsule may be employed.

Pro-perfume—The perfume component of the treatment composition of the present disclosure may additionally include a pro-perfume. Pro-perfumes may comprise nonvolatile materials that release or convert to a perfume material as a result of, e.g., simple hydrolysis, or may be pH-change-triggered pro-perfumes (e.g. triggered by a pH drop) or may be enzymatically releasable pro-perfumes, or light-triggered pro-perfumes. The pro-perfumes may exhibit varying release rates depending upon the pro-perfume chosen. Pro-perfumes suitable for use in the disclosed compositions are described in the following: U.S. Pat. Nos. 5,378,468; 5,626,852; 5,710,122; 5,716,918; 5,721,202; 5,744,435; 5,756,827; 5,830,835; and 5,919,752.

Builders—The treatment compositions of the present disclosure may comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The treatment compositions may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The treatment compositions of the present disclosure may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole (PVPVI), polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The treatment compositions of the present disclosure may also contain dispersants. Suitable water-soluble organic materials are the homo- or co-polymeric acids or their salts, in which the polycarboxylic acid may comprise at least two carboxyl radicals separated from each other by not more than two carbon atoms, ethoxylated tallow amines, linear or branched fatty alcohol alkoxylates, and mixtures thereof.

Enzymes—The treatment compositions may comprise one or more detergent enzymes, which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in the treatment compositions, e.g., detergents, may be stabilized by various techniques. The enzymes employed herein can be stabilized by the presence of water-soluble sources of calcium and/or magnesium ions in the finished compositions that provide such ions to the enzymes.

Hueing Dyes—The composition may comprise a fabric hueing agent (sometimes referred to as shading, bluing or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

In some aspects, the treatment composition comprises an amino silicone nanoemulsion and a carrier. In some aspects, the treatment composition comprises an amino silicone nanoemulsion, a carrier, and a perfume.

In certain aspects of the present disclosure, the treatment composition is a fabric care composition. Such a fabric care composition may take the form of a rinse added fabric conditioning compositions. Such compositions may comprise a fabric softening active and a dispersant polymer, to provide a stain repellency benefit to fabrics treated by the composition, typically from about 0.00001 wt. % (0.1 ppm) to about 1 wt. % (10,000 ppm), or even from about 0.0003 wt. % (3 ppm) to about 0.03 wt. % (300 ppm) based on total rinse added fabric conditioning composition weight. In another specific aspect, the compositions are rinse added fabric conditioning compositions. Examples of typical rinse added conditioning composition can be found in U.S. Provisional Patent Application Ser. No. 60/687,582 filed on Oct. 8, 2004.

Methods of Using Treatment Compositions

The treatment compositions of the present disclosure may be used in a method of treating a surface. The method of treating a surface comprises the step of applying the amino silicone nanoemulsion treatment composition of the present disclosure to a surface, where the surface is selected from fabric or a hard surface.

Fabric Treatment

The treatment compositions disclosed in the present specification may be used to treat a fabric, such as those described herein. Typically at least a portion of the fabric is contacted with an embodiment of the aforementioned fabric care compositions, in neat form or diluted in a liquor, for example, a wash liquor and then the fabric may be optionally washed and/or rinsed and/or dried without further treatment. In one aspect, a fabric is optionally washed and/or rinsed, contacted with an embodiment of the aforementioned fabric care compositions and then optionally washed and/or rinsed. For purposes of the present disclosure, washing includes but is not limited to, scrubbing, and mechanical agitation. The fabric may comprise most any fabric capable of being laundered or treated.

The fabric care compositions disclosed in the present specification can be used to form aqueous washing or treatment solutions for use in the laundering and/or treatment of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith. An effective amount of the fabric care composition, such as the liquid detergent compositions disclosed in the present specification, may be added to water to form aqueous laundering solutions that may comprise from about 500 to about 7,000 ppm or even from about 1,000 to about 3,000 ppm of fabric care composition.

In one aspect, the fabric care compositions may be employed as a laundry additive, a pre-treatment composition and/or a post-treatment composition.

Without being bound by theory it is believed the treatment of a fabric with compositions disclosed in the present specification may increase the time-to-wick of the fabric. Table VII shows an increase in the time-to-wick of cotton fabric as a result of treatment with examples of compositions disclosed in the present specification.

In some aspects, there is provided a method of treating a surface comprising the step of applying the amino silicone nanoemulsion treatment composition of the present disclosure to a surface, where the surface is a fabric and where the water repellency relative to the untreated fabric is increased, as measured by an increase in Time to Wick. In certain aspects, the increase in Time to Wick is greater than about 100 seconds, or greater than about 500 seconds, or greater than about 1200 seconds. In some aspects, the oil repellency relative to the untreated fabric is increased, as measured by an increase in Time to Wick. In some aspects, the oil repellency relative to the untreated fabric is increased, as measured by an increase in Time to Wick greater than about 10 seconds.

Hard Surfaces

The treatment compositions disclosed in the present specification may be used to clean or treat hard surfaces, such as those described herein. Typically at least a portion of the hard surface is contacted with an embodiment of the aforementioned hard surface care compositions, in neat form or diluted in a liquor, for example, a wash liquor and then the hard surface may be optionally washed and/or rinsed and/or dried without further treatment. In one aspect, a hard surface is optionally washed and/or rinsed, contacted with an embodiment of the aforementioned hard surface care compositions and then optionally washed and/or rinsed and/or dried without further treatment. For purposes of the present disclosure, washing includes but is not limited to, scrubbing, and mechanical agitation.

The hard surface care compositions disclosed in the present specification can be used to form aqueous washing or treatment solutions for use in the washing and/or treatment of hard surfaces. Generally, an effective amount of such compositions is added to water to form such aqueous washing and/or treatment solutions. The aqueous washing and/or treatment solution so formed is then contacted with the hard surface to be washed or treated therewith.

Without being bound by theory, it is believed the treatment of the hard surface with compositions disclosed in the present specification may increase the contact angle of water or water-based composition and/or oily substances on the hard surface. Without being bound by theory it is believed that increasing the contact angle of substances on a hard surface increases the ease of removing said substances from the surface In some aspects, there is provided a method of treating a surface comprising the step of applying the amino silicone nanoemulsion treatment composition of the present disclosure to a surface, where the surface is a hard surface and where the contact angle relative to the untreated hard surface is increased.

While various specific embodiments have been described in detail herein, the present disclosure is intended to cover various different combinations of the disclosed embodiments and is not limited to those specific embodiments described herein. The various embodiments of the present disclosure may be better understood, when read in conjunction with the following representative examples. The following representative examples are included for purposes of illustration and not limitation.

TEST METHODS

Time to Wick (T2W) Measurement Method

The fabric Time to Wick property is a measure of the water repellency of a fabric, where longer times indicate greater repellency. Water repellency is measured when a drop of water is applied to the fabric, such as white 6.1 oz (165-200 gsm) Gildan Ultra 100% Cotton t-shirts (size large, item number 2000, Gildan USA, Charleston, S.C.). The Gildan t-shirts are prepared by de-sizing for 2 cycles of laundering with clean rinses using the AATCC 2003 standard reference liquid detergent without optical brighteners (AATCC—American Association of Textile Chemists and Colorists, Research Triangle Park, N.C., USA) in a standard top-loader, North American style washing machine, such as a Kenmore 600 Model 110.28622701. For treatment, 12 t-shirts are added to the drum of a standard washing machine, set on Heavy Duty wash cycle, water level equal to 17 gallons (Super load size), warm water, selected with single rinse option. Water is regulated to standardize the wash temperature to 90° F., Rinse to 60° F., and water hardness to 6 grain per gallon. Detergent is added to the wash water, such as Tide liquid Detergent (50.0 g dose), Clean Breeze scent. With the fabrics in the washer, the rinse water is allowed to fill the tub. Prior to agitation, the fabric treatment composition of the present invention (40 grams) is equally dispersed and added to the rinse water, followed by completion of the rinse cycle. The garments are then placed in a standard dryer, such as a Kenmore standard 80 series, cotton cycle (high heat), for 30 minutes or until dry. The fabrics are then removed from the dryer and placed in a cool, well ventilated room with controlled humidity set at 50% RH, and temperature regulated to 70° F., for a period of 24-48 hours. The section of the fabric that will be measured for Time to Wick is subjected to UV light, such as standard overhead lab lighting, for 24-48 hours prior to measurement. Treated test fabric is compared for Time to Wick value versus an untreated control fabric that has been prepared in a similar manner as the test fabric without the addition of the fabric treatment composition.

The Time to Wick value is measured as follows: On a flat, level hard surface (e.g. benchtop) a fresh square of a paper towel at least 10 cm×10 cm in size, is placed inside the prepared t-shirt so that 1 layer of fabric is being measured. A 300 μL drop of DI water is then dispensed onto the fabric surface from a calibrated pipette. The process of absorption of the liquid drop is visually monitored and recorded counting the time elapsed in seconds. Eight drops are administered per t-shirt, with each drop placed at a different location separate from all adjacent drops.

For each drop, the time differential between when the drop is applied and when absorbed is calculated and recorded in seconds. The time at drop absorption is defined as being the earliest time point at which no portion of the drop is observed remaining above the surface of the fabric. If the drop remains after 10 minutes, observation is discontinued. Such drops are recorded as having a time differential of 600 seconds. The Time to Wick value for a given liquid on fabric is the average of the time differentials recorded for 8 drops of that liquid. In order to determine the effect of a treatment, comparisons are made between the average Time to Wick value obtained from the treated fabric, versus the average obtained from its untreated control fabric using the same liquid, where longer times indicate greater repellency.

Particle Size Measurement Test Method by Using Malvern Zetasizer Nano ZS

The organosilicone nanoemulsions finished product containing the nanoemulsions are measured either neat or diluted with DI water to a specific concentration (1:10, 1:500 or 1:1000) with filtered DI water (using Gelman acrodisc LC PVDF 0.45 μm) prior to making particle size measurements. The particle size measurement is performed immediately after the sample completely disperses in water. The data is reported as the average of 3 readings.

Sample Preparation:

The dilution used will be dependent upon the type of sample: silicone emulsions are diluted at a concentration of 1:500 and 1:1000 and finish products are measured as neat and diluted to a concentration of 1:10 in DI water.

- Before diluting the sample, gently invert it several times to mix it well.
- Rinse the 10 ml vial with filtered DI water to remove any dust then pipette a specific amount of filtered DI water and sample to the vial to make up the correct concentration (1:10, 1:500 or 1:1000). Invert the vial several times to make sure the sample completely disperses in water.
- Add 1 ml of diluted sample or neat sample to a clean cuvette ensuring that there are no air bubbles present in the sample.

Instrument Set up Conditions:

The particle size measurements are made via Malvern Zetasizer Nano Series ZS, with model #ZEN3600 with the fixed parameter settings for both Silicone emulsion and finish product:

- Material: Silicone
  - Refractive Index (RI) 1.400
  - Absorption 0.001
- Dispersion: Water
  - Temp. 25° C.
  - Viscosity 0.8872 cP
  - RI 1.33
- General Option: Using dispersant viscosity as sample viscosity
- Temperature: 25° C.
- Aging time: 0 second
- Cell Type: DTS0012- Disposable sizing cuvette
- Measurement: Meas. Angle 173° Backscatter (NIBS default)

Meas. Duration Manual
Number of runs 3
Run duration 60 s
Number of Meas. 3
Delay between meas. 0 s
Positioning method Seek for optimum position
Automatic attenuation selection Yes Data Processing: Analysis model General purpose (normal resolution)

Test Method for Determining the Range of Nanoparticle Typical Diameters and the Presence/Absence of Nanoparticle Aggregates, using a Cryo-Transmission Electron Microscope (cryo-TEM).

Samples of the liquid composition to be tested are prepared for microscopic analysis in order to observe nanoparticles that may be suspended in the composition. Sample preparation involves pipetting approximately 5 μl of the liquid composition onto a holey carbon grid (such as Lacey Formvar Carbon on 300 mesh copper grid, P/N 01883-F, available from Ted Pella Inc., Redding, Calif., U.S.A., or similar). The excess liquid is blotted away from the edge of the grid with a filter paper (such as Whatman brand #4, 70 mm diameter, manufactured by GE Healthcare/General Electric Company, Fairfield, Conn., U.S.A., or similar). The grid-mounted sample is plunged rapidly into liquid ethane using a freezing apparatus capable of producing a flash-frozen vitreous thin film of sample lacking crystalline ice (such as a Controlled Environment Vitrification System (CEVS device), or similar apparatus). The apparatus configuration and use of a CEVS device is described in the Journal of Electron Microscopy Technique volume 10 (1988) pages 87-111. Liquid ethane may be prepared by filling an insulated container with liquid nitrogen and placing a second smaller vessel into the liquid nitrogen. Gaseous ethane blown through a syringe needle into the second vessel will condense into liquid ethane. Tweezers pre-cooled in liquid nitrogen are used to rapidly handle the frozen grids while taking great care to maintain the vitreous non-crystalline state of the sample and minimize the formation of frost on the sample. After being flash frozen the grid-mounted samples are stored under liquid nitrogen until being loaded into the cryo-TEM via a cryo transfer holder (such as Gatan model 626 Cryo-Holder available from Gatan Inc., Warrendale, Pa., U.S.A., attached to a TEM instrument such as the model Tecnai $G^2$ 20 available from FEI Company, Hillsboro, Oreg., U.S.A., or similar). The cryo-TEM is equipped with a camera such as the Gatan Model 994 UltraScan 1000XP (available from Gatan Inc., Warrendale, Pa., U.S.A.). The grid-mounted frozen samples are imaged in the cryo-TEM using low beam dosages (such as 200 KV in Low Dose Mode) in order to minimize sample damage. Suitable magnifications are selected in order to observe the size of nanoparticles which may be present. This may include magnifications in the range of 5,000×-25,000×. During imaging the sample is kept as cold as possible, typically at or near the temperature of liquid nitrogen (approximately minus 175° C.). Images of the samples are carefully examined to detect the presence of artefacts. A grid-mounted sample is discarded if any crystalline ice. Images are inspected for beam damage artefacts and are rejected if damage is observed. For each grid-mounted sample, representative images are captured of approximately 40 fields of view which are representative of the sample. These images are used to determine the range of nanoparticle typical diameters, and to determine the presence or absence of nanoparticle aggregates. In each image, the diameters are measured from nanoparticles which are typical of that image. The range of typical diameter values reported for the composition is the range of the diameters measured across all images captured from that composition. In each image, the spacing between nanoparticles is observed. A nanoparticle aggregate is defined as a cluster which contains at least 10 nanoparticles clumped together, rather than being individually dispersed. Nanoparticle aggregates are reported as present if at least one nanoparticle aggregate is observed in at least one image captured from that composition.

EXAMPLES

1. Solvent Examples

The following list of solvent options is for illustrative purposes of making the silicone resin solution of example prep 2 below and is considered to be non-limiting:

TABLE I

| Example Solvents | | | |
|---|---|---|---|
| | A | B | C |
| Guerbet Alcohols | 2-Ethylhexanol[1] | 2-Butyloctanol[2] | 2-Hexyldecanol[3] |
| | D | E | F |
| Glycol Ethers | Propyleneglycol n-Butyl ether[4] | Dipropyleneglycol n-Butyl ether[5] | Tripropyleneglycol n-Butyl ether[6] |
| | G | H | I |
| Fatty Esters | Isopropyl Laurate[7] | Isopropyl Myristate[8] | Isopropyl Palmitate[9] |

2. Preparation of Resin Solution

In a 400 mL beaker add specified amount of MQ resin powder ($\{[Me_3SiO_{1/2}]_{0.373}[SiO_2]_{0.627}\}_{40}$, Mn=2700 g/mol, resin contains 0.2% OH and 3.1% OEt [corresponds to $OR^{10}$]) according to Table II below; slowly add solvent(s) and begin mixing using an Ika RWA-20 mixer with a 4-blade agitator (2 inch diameter tip-to-tip)_having 45° pitch on each blade using appropriate level of agitation. Continue with gentle mixing until all resin powder is completely dissolved; allow solution to settle at least 24 hours to allow for complete de-aeration.

TABLE II

| Example Resin solution compositions | | | | | | | | | | | |
|---|---|---|---|---|---|---|---|---|---|---|---|
| | Resin Solution Examples | | | | | | | | | | |
| Component | J | K | L | M | N | O | P | Q | R | S | T |
| Resin Powder[10] | 55.7 | 55.7 | 55.7 | 55.7 | 55.7 | 55.7 | 55.7 | 55.7 | 55.7 | 55.7 | 55.7 |
| Total Solvent wt. (g) | 44.3 | 44.3 | 44.3 | 44.3 | 44.3 | 44.3 | 44.3 | 44.3 | 44.3 | 44.3 | 44.3 |
| Butyl Carbitol[11] | 0 | 2.0 | 4.0 | 6.0 | 8.0 | 10.0 | 12.0 | 14.0 | 16.0 | 18.0 | 19.0 |
| Solvent A-I | 44.3 | 42.3 | 40.3 | 38.3 | 36.3 | 34.3 | 32.3 | 30.3 | 28.3 | 26.3 | 25.3 |

3. Preparation of Resin-Aminosilicone Oil Mixture

To a 6 oz. glass container add 76.3 g of aminosilicone fluid and 23.7 g of resin solution according to Table III below.

The amine oil U has a viscosity about 1000 $mm^2/s$ at 25° C. [corresponds to units of formulas 7+8+9+10=230], functional radicals —$(CH_2)_3NH(CH_2)NH_2$ [corresponds to $R^2$], amine number of 0.5 mmol/g, 92% $SiMe_3$ end groups, and 8% $SiMe_2OH$ end groups [corresponds to units of formulas 9/10=11.5].

The amine oil V has a viscosity about 1000 $mm^2/s$ at 25° C. [corresponds to units of formulas 7+8+9+10=230], functional radicals —$(CH_2)_3NH(CH_2)NH_2$ [corresponds to $R^2$], amine number of 0.5 mmol/g, 85% $SiMe_3$ end groups, and 15% $SiMe_2OH$ end groups [corresponds to units of formulas 9/10=5.7].

The amine oil W has a viscosity about 1000 $mm^2/s$ at 25° C. [corresponds to units of formulas 7+8+9+10=230], functional radicals —$(CH_2)_3NH(CH_2)NH_2$ [corresponds to $R^2$], amine number of 0.5 mmol/g, 80% $SiMe_3$ end groups, and 20% $SiMe_2OH$ end groups [corresponds to units of formulas 9/10=4.0].

Mix fluids until completely homogenous using an Ika® RWA-20 mixer with a 4-blade agitator having 45° pitch on each blade using appropriate level of agitation. Place lid on container and allow oil mixture to age at room temperature for at least 72 hours.

TABLE III

| Example Resin-Aminosilicone Oil mixture solutions | | | |
|---|---|---|---|
| | Resin-AminoSilicone Oil Mixture Examples | | |
| Example | U | V | W |
| Aminosilicone Terminal group | 8%-OH termination | 15%-OH termination | 20%-OH termination |
| Aminosilicone amt. (g) | 76.3 | 76.3 | 76.3 |
| Resin solution, Ex. J-T (g) | 23.7 | 23.7 | 23.7 |

4. Preparation of Aminosilicone-Resin Emulsion

In a 250 mL beaker add 78.0 g of oil mixture from examples U-W above, followed by additional solvent according to Table IV below. Begin mixing solution using an Ika® RWA-20 mixer with a 4-blade agitator having 45° pitch on each blade using appropriate level of agitation. Continue mixing; once solvent has completely incorporated, add specified protonation agent to the mixture; add remaining water slowly and in 3 separate but equal increments, allowing each addition to fully incorporate prior to adding the next. Continue agitation to ensure the mixture is completely emulsified.

TABLE IV

| Example Aminosilicone-Resin Emulsions | | | | | | |
|---|---|---|---|---|---|---|
| | Silicone-Resin Emulsion Examples | | | | | |
| Component (g) | AA | BB | CC | DD | EE | FF |
| Oil Mix. Example U-W | 39.0 | 39.0 | 39.0 | 39.0 | 39.0 | 39.0 |
| Solvent from examples A-I[1-9] | — | 1.5 | 1.2 | 0.8 | 9.75 | 19.5 |
| Butyl Carbitol[11] | 19.5 | 18.0 | 18.3 | 18.7 | 9.75 | 0.0 |
| Resin Composition from Table II | T | J, T | T | T | T | J-T |
| Protonating Agent[12] | 0.9 | 0.9 | 0.9 | 0.9 | 0.9 | 0.9 |
| Water (13.5 g × 3) | 40.6 | 40.6 | 40.6 | 40.6 | 40.6 | 40.6 |
| Total Amount (g) | 100.0 | 100.0 | 100.0 | 100.0 | 100.0 | 100.0 |

5. Finished Product Formulation Examples

In a 400 mL beaker, add specified amount of emulsion from examples AA-FF, followed by perfume; begin mixing solution using an Ika® RWA-20 mixer with a 4-blade agitator having 45° pitch on each blade using appropriate level of agitation. Add solvent to the mixture with continued agitation, allowing solvent to fully incorporate. Add deposition aid polymer followed by water; continue to mix until fully incorporated. Add preservative, followed by surfactant, then add the protonating agent and allow the mixture to fully incorporate. Finish product with continued agitation by adding the dye following the specified order of addition in Table V below:

TABLE V

Example Finished Product Formulations

| Component (g) | Finished Product Example Formulations | | | | | | | |
|---|---|---|---|---|---|---|---|---|
| | Comparative Example GG | Order of Addition | HH | Order of Addition | Comparative Example II | Order of Addition | Comparative Example JJ | Order of Addition |
| Emulsion from ex. AA-FF | 25.8 | 1 | 25.8 | 1 | 25.8 | 1 | 25.8 | 2 |
| Perfume | 0.8 | 2 | 0.8 | 2 | 0.8 | 2 | 0.8 | 3 |
| Butyl Carbitol | 4.0 | 3 | 4.0 | 3 | — | — | 4.0 | 4 |
| Solvent ex. A-I | — | — | — | | 4.0 | 3 | — | — |
| Surfactant[12] | 0.1 | 4 | 0.1 | 7 | 0.1 | 7 | 0.1 | 5 |
| Protonating Agent[13] | 0.25 | 5 | 0.25 | 8 | 0.25 | 8 | 0.25 | 6 |
| Water | 62.65 | 6 | 62.65 | 5 | 62.65 | 5 | 62.65 | 1 |
| Deposition Aid Polymer[14] | 6.35 | 7 | 6.35 | 4 | 6.35 | 4 | 6.35 | 7 |
| Preservative[15] | 0.1 | 8 | 0.1 | 6 | 0.1 | 6 | 0.1 | 8 |
| Dye[16] | 0.004 | 9 | 0.004 | 9 | 0.004 | 9 | 0.004 | 9 |

[1]2-Ethyhexanol: Available from Sigma-Aldrich, St. Louis, MO
[2]2-Butyloctanol: Available from Sasol Chemical, Johannesburg, South Africa
[3] 2-Hexyldecanol: Available from Sigma-Aldrich, St. Louis, MO
[4]Propyleneglycol n-butyl ether: Available from Dow Chemical, Midland MI
[5]Dipropyleneglycol n-butyl ether: Available from Dow Chemical, Midland MI
[6]Tripropyleneglycol n-butyl ether: Available from Dow Chemical, Midland MI
[7]Isopropyl Laurate: Available from Sigma-Aldrich, St.Louis, MO
[8]Isopropyl Myristate: Available from Evonik Corporation, Hopewell, VA.
[9]Isopropyl Palmitate: Available from Evonik Corporation, Hopewell, VA.
[10]Silicone MQ Resin: Wacker MQ 803TF, available from Wacker Chemie, AG; Burghausen, Germany
[11]Butyl Carbitol: available from Dow Chemical, Midland MI
[12]Surfactant: TAE-80, Tallow Alkyl ethoxylate, available from Akzo-Nobel
[13]Protonating Agent: Glacial Acetic Acid, 97%, available from Sigma-Aldrich, St.Louis, MO
[14]Deposition Aid Polymer: Terpolymer of acrylamide, acrylic acid and methacrylamidopropyl trimethylammonium chloride; Available from Nalco Chemicals, Naperville, IL
[15]Preservative: Proxel GXL, available from Lonza Group, Basel, Switzerland
[16]Dye: Liquitint Blue AH; available from Milliken, Spartanburg, SC Data:

TABLE VI

Characterization of Finished product for Appearance and Particle size

| | Finished Product (FP) Formulation Example | | | |
|---|---|---|---|---|
| | GG | HH | II | JJ |
| Cryo-TEM visual appearance | Product Phase split | Uniform particles, no void volumes | Product Phase split | Distribution of particle sizes, apparent void volumes |
| Avg. Particle Size (nm.); FP | Not Tested | 373 | Not Tested | 497 |

TABLE VII

Stability of Finished Products and Performance

| | Finished Product (FP) Formulation Example | | | |
|---|---|---|---|---|
| | GG | HH | II | JJ |
| Initial Product Stability | Fail | Pass | Fail | Pass |
| Initial TTW Performance* | Not Tested | 100% Pass, avg. TTW = 328 sec. | Not Tested | 92% Pass, avg. TTW = 162 sec. |
| 8 Week Stability | Not Tested | Pass | Not tested | Fail |

TABLE VII-continued

Stability of Finished Products and Performance

| | Finished Product (FP) Formulation Example | | | |
|---|---|---|---|---|
| | GG | HH | II | JJ |
| 8 Week TTW Performance | Not Tested | 100% Pass, avg. TTW = 295 sec. | Not Tested | Not Tested |

*TTW = Time to Wick;

% Pass is determined by the number of treated garments tha exhibit an average Time to Wick of >30 seconds

TABLE VIII

| Representative Cryo-TEM Images of Fabric Treatment Compositions | | | |
|---|---|---|---|
| | Formulation | | |
| | JJ | HH | GG |
| | Cyro-TEM Image | | |
| | 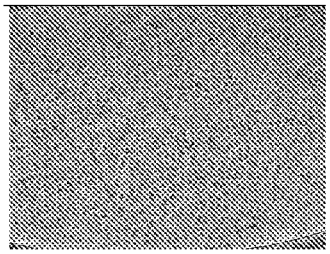 | 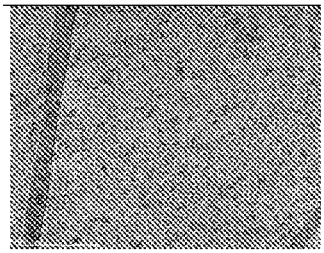 | 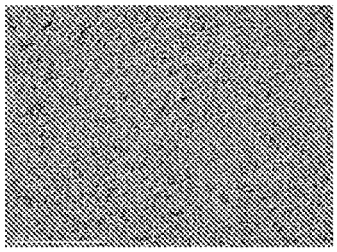 |
| Description | Tecnai TEM image at 200 KV in low dose mode; image shows uniform particle size distribution with no abnormalities or areas showing changes in particle density | Tecnai TEM image at 200 KV in low dose mode; image shows varying particle size distribution with some abnormalities and areas showing changes in particle density | Tecnai TEM image at 200 KV in low dose mode; image shows varying particle size distribution with some abnormalities and areas showing changes in particle density |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any crossreferenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A fabric treatment composition comprising a nanoemulsion made by a process comprising the steps of:

a) solubilizing a silicone resin in an organic solvent system to yield a silicone resin solution concentration of about 80% or less, wherein the organic solvent system comprises diethyleneglycol monobutyl ether and at least one additional solvent selected from the list consisting of monoalcohols, polyalcohols, ethers of monoalcohols, ethers of polyalcohols, fatty esters, Guerbet alcohols, isoparaffins, naphthols, glycol ethers or mixtures thereof, provided that if the additional solvent is a glycol ether it is not diethyleneglycol monobutyl ether;

b) mixing the silicone resin solution from a) with an aminosiloxane polymer to obtain an aminosiloxane polymer:silicone resin mixture having ratio of about 20:1;

c) allowing the aminosiloxane polymer:silicone resin mixture to age for at least about 6 hours at ambient temperature;

d) adding the aminosiloxane polymer:silicone resin mixture to a vessel;

e) optionally adding with agitation an additional organic solvent to the aminosiloxane polymer:silicone resin mixture;

f) mixing until homogenous;

g) adding a protonating agent;

h) additionally adding an aqueous carrier in an amount to produce the desired concentration of nanoemulsion;

i) adding said nanoemulsion to a vessel;

j) with mixing, adding to the vessel containing the aforementioned nanoemulsion a perfume oil;

k) adding an organic solvent;

l) optionally, adding a deposition aid polymer;

m) adding additional water to achieve the desired finished product concentration;

n) optionally, adding a preservative;

o) adding a dispersant;

p) adding a protonating agent; and q) optionally adding a dye.

2. A fabric treatment composition according to claim 1 wherein the fabric treatment composition has a pH of less than about 7.

3. A fabric treatment composition according to claim 2 wherein the fabric treatment composition has a pH of from about 1 to about 6.5.

4. A fabric treatment composition according to claim 1 wherein said emulsion has an average particle size less than 1 um.

5. A composition according to claim 4 wherein said emulsion has an average particle size greater than about 30 nm but less than about 500 nm.

6. A composition according to claim 1 having a time to wick of greater than about 30 seconds when applied to a fabric surface.

7. The fabric treatment composition of claim 1, wherein said treatment composition is selected from the group consisting of laundry spray composition, laundry rinse additive composition, and hard surface cleaning compositions.

8. A fabric treatment composition according to claim 1 wherein said treatment composition further comprises an adjunct ingredient.

9. The fabric treatment composition of claim 8 where the adjunct ingredient is selected from the group consisting of builders, deposition aid polymers, chelating agents, dye transfer inhibiting agents, dispersants, enzymes, and enzyme stabilizers, catalytic materials, bleach, bleach activators, polymeric dispersing agents, clay soil removal/anti-redeposition agents, brighteners, dyes, hueing agents, UV absorbers, perfume, perfume delivery systems, structure elasticizing agents, thickeners/structurants, fabric softeners, carriers, hydrotropes, processing aids, oligoamines, and/or pigments.

10. A fabric treatment composition according to claim 9 wherein:

a) said fabric softener active is selected from the group consisting of polyglycerol esters, oily sugar derivatives, wax emulsions, fatty acids, N, N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl)N-(2hydroxyethyl)N-methyl ammonium methylsulfate and mixtures thereof;

b) said deposition aid polymer comprises a cationic polymer having a cationic charge of from about 0.005 meq/g to about 23 meq/g, at the pH of said composition;

c) said preservative is selected from the group consisting of alcohols, formaldehyde, parabens, benzyl alcohol, propionic acid and salts thereof and also isothiazolinones;

d) said perfume delivery system comprises components selected from the group consisting of a perfume microcapsule, or a moisture-activated perfume microcapsule, wherein the microcapsule comprises a shell comprising a polyacrylate and/or a polymer crosslinked with an aldehyde, wherein said perfume carrier may be selected from the group consisting of cyclodextrins, starch microcapsules, porous carrier microcapsules, and mixtures thereof; and wherein said encapsulated perfume composition may comprise low volatile perfume ingredients, high volatile perfume ingredients, and mixtures thereof;

e) said enzyme is selected from the group consisting of protease, amylase, lipase, mannanase, cellulase, and mixtures thereof;

f) said structurant is selected from the group of hydrogenated castor oil; derivatives of hydrogenated castor oil; microfibrillar cellulose;

hydroxyfunctional crystalline materials, long-chain fatty alcohols, 12-hydroxystearic acid; clays; and mixtures thereof;

g) said polymeric dispersing agent is selected from the group consisting of homo- or co-polymeric acids or the salts of water-soluble organic materials in which the polycarboxylic acid may comprise at least two carboxyl radicals separated from each other by not more than two carbon atoms, ethoxylated tallow amines, linear or branched fatty alcohol alkoxylates, polyvinylpyrrolidone polymers, polyamine N-oxide polymers, copolymers of N-vinylpyrrolidone and N-vinylimidazole (PVPVI), polyvinyloxazolidones and polyvinylimidazoles, and mixtures thereof; and h) said hueing agent is selected from the group consisting of acridine, anthraquinone, polycyclic quinones, azine, monoazo, disazo, trisazo, tetrakisazo, polyazo, premetallized azo, benzodifurane, benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

11. A fabric treatment composition according to claim 9 wherein:

a) said perfume oil comprises perfume raw materials having less than about 50% of free aromatic aldehydes and free aromatic ketones, by weight of the total perfume oil;

b) said organic solvent comprises a solvent selected from the group consisting of monoalcohols, polyalcohols, ethers of monoalcohols, ethers of polyalcohols, fatty esters, Guerbet alcohols, isoparaffins, naphthols, glycol ethers, and mixtures thereof;

c) said deposition aid polymer comprises a cationic polymer having a cationic charge of from about 0.005 meq/g to about 23 meq/g, at the pH of said composition;

d) said preservative is selected from the group consisting of alcohols, formaldehyde, parabens, benzyl alcohol, propionic acid and salts thereof and isothiazolinones;

e) said dispersant is selected from the group consisting of homo- or co-polymeric acids or their salts, in which the polycarboxylic acid may comprise at least two carboxyl radicals separated from each other by not more than two carbon atoms, ethoxylated tallow amines, linear or branched fatty alcohol alkoxylates, and mixtures thereof;

f) said protonating agent is selected from a monoprotic or multiprotic, water-soluble or water-insoluble, organic or inorganic acid.

12. A fabric treatment composition according to claim 11 wherein:

a) said organic solvent comprises a Guerbet alcohol or a glycol ether, and mixtures thereof, and is selected from 2-ethyl hexanol, 2-butyl octanol, 2-hexyl decanol, ethyleneglycol methyl ether, ethyleneglycol ethyl ether, ethyleneglycol propyl ether, ethyleneglycol butyl ether, ethyleneglycol butyl ether acetate, ethyleneglycol phenyl ether, ethyleneglycol hexyl ether, diethyleneglycol methyl ether, diethyleneglycol ethyl ether, diethyleneglycol propyl ether, diethyleneglycol butyl ether, diethyleneglycol phenyl ether, diethyleneglycol hexyl ether, propyleneglycol methyl ether, propyleneglycol methyl ether acetate, propyleneglycol methyl ether diacetate, propyleneglycol propyl ether, propyleneglycol butyl ether, propyleneglycol phenyl ether, dipropyleneglycol methyl ether, dipropyleneglycol methyl ether acetate, dipropyleneglycol propyl ether, dipropyleneglycol butyl ether, tripropyleneglycol methyl ether, tripropyleneglycol propyl ether, and tripropyleneglycol butyl ether, and mixtures thereof;

b) said deposition aid polymer comprises a cationic polymer having monomeric units selected from acrylamide and methacrylamidopropyltrimethyl ammonium chloride;

c) said preservative is an isothiazolinone;

d) said dispersant is a fatty alcohol ethoxylate having on average 80 moles or less of ethoxylation;

e) said protonating agent is selected from formic acid, acetic acid, sulphuric acid, phosphoric acid, hydrochloric acid, citric acid and mixtures thereof.

* * * * *